US007662192B2

(12) United States Patent
Hanada et al.

(10) Patent No.: US 7,662,192 B2
(45) Date of Patent: Feb. 16, 2010

(54) CLEANING AND RINSING METHOD

(75) Inventors: Tsuyoshi Hanada, Ichihara (JP); Hidekazu Okamoto, Yokohama (JP); Masaaki Tsuzaki, Ichihara (JP); Maki Shigematsu, Ichihara (JP)

(73) Assignee: Asahi Glass Company, Limited, Tokyo (JP)

( * ) Notice: Subject to any disclaimer, the term of this patent is extended or adjusted under 35 U.S.C. 154(b) by 592 days.

(21) Appl. No.: 11/316,811

(22) Filed: Dec. 27, 2005

(65) Prior Publication Data

US 2006/0135390 A1 Jun. 22, 2006

Related U.S. Application Data

(63) Continuation of application No. PCT/JP2004/008981, filed on Jun. 25, 2004.

(30) Foreign Application Priority Data

Jun. 27, 2003 (JP) ..... 2003-184722

(51) Int. Cl.
*C11D 7/50* (2006.01)

(52) U.S. Cl. ..... 8/142; 510/407; 510/412

(58) Field of Classification Search ..... 8/142; 510/407, 412

See application file for complete search history.

(56) References Cited

U.S. PATENT DOCUMENTS

| | | | | |
|---|---|---|---|---|
| 6,310,018 | B1 * | 10/2001 | Behr et al. | 510/175 |
| 7,053,035 | B2 * | 5/2006 | Hanada et al. | 510/407 |
| 2002/0107160 | A1 * | 8/2002 | Zazzera et al. | 510/175 |
| 2003/0168079 | A1 * | 9/2003 | Kabashima et al. | 134/11 |
| 2005/0252523 | A1 * | 11/2005 | Ishikawa et al. | 134/1 |

FOREIGN PATENT DOCUMENTS

| | | |
|---|---|---|
| JP | 4-182062 | 6/1992 |
| JP | 4-227695 | 8/1992 |
| JP | 4-270799 | 9/1992 |
| JP | 5-271692 | 10/1993 |
| JP | 6-128592 | 5/1994 |
| JP | 7-74136 | 3/1995 |
| JP | 10-36894 | 2/1998 |
| JP | 10-202209 | 8/1998 |
| JP | 11-279098 | 10/1999 |
| JP | 2001-172683 | 6/2001 |
| JP | 2001-300446 | 10/2001 |
| JP | 2003-327999 | 11/2003 |

* cited by examiner

*Primary Examiner*—Gregory E Webb
(74) *Attorney, Agent, or Firm*—Oblon, Spivak, McClelland, Maier & Neustadt, L.L.P.

(57) ABSTRACT

The present invention provides a method for cleaning and rinsing an article, with excellent cleaning and rinsing performance.

The present invention provides a method for cleaning and rinsing an article, characterized by comprising a cleaning step of contacting an article having a contaminant attached, with a hydrocarbon solvent containing an aromatic hydrocarbon or a glycol ether, and a rinsing step of contacting it with a fluorinated ether, wherein the fluorinated ether is a compound represented by the formula 1:

$$R^1—O—R^2 \qquad \text{Formula 1}$$

wherein each of $R^1$ and $R^2$ which are independent of each other, is a fluorinated alkyl group, wherein the number of fluorine atoms contained in each of $R^1$ and $R^2$ is at least one, and the total number of carbon atoms contained in $R^1$ and $R^2$ is from 4 to 8.

16 Claims, No Drawings

CLEANING AND RINSING METHOD

TECHNICAL FIELD

The present invention relates to a cleaning and rinsing method with the use of a nonflammable solvent which is used for removing dirt such as oils and fats adhering to articles such as electronic parts, e.g., ICs, precision instrument parts, glass substrates and resin molded parts, and flux and dust on printed circuit boards.

BACKGROUND ART

Heretofore, a hydrochlorofluorocarbon (hereinafter referred to as "HCFC") such as dichloropentafluoropropane (hereinafter referred to as "R-225") was widely used as a fluorocarbon solvent for precision cleaning in order to remove oils, flux, dust, waxes and the like adhering to articles, e.g., during processing and machinery steps in the precision instrument industry, the optical instrument industry, the electrical and electronic industry, the plastic processing industry, and so on.

However, use of HCFC will be totally abolished in advanced countries until 2020 because of its ozone depletion potential. Hydrofluorocarbon (hereinafter referred to as "HFC"), hydrofluoroether (hereinafter referred to as "HFE") and the like are known as fluorocarbon solvents which are alternatives for HCFC, which contain no chlorine in their molecule and which have the ozone depletion potential of zero.

For example, there is a known method for cleaning an article composed of a printed-circuit board, metal and so on, with the use of HFE having a boiling point of about from 20 to 120° C. (cf. Patent Document 1). However, this method often fails to adequately remove a contaminant because the solvency of HFE for the contaminant is not sufficient. There is another known method for cleaning an article with the use of an aliphatic hydrocarbon or the like.

However, there was a problem that these hydrocarbon solvents were unlikely to dry and a lot of energy was thus required to dry the article after cleaning, though these hydrocarbon solvents have the ozone depletion potential of zero and high removal efficiency of the contaminant.

A method for rinsing with HFE after cleaning with a hydrocarbon solvent (cf. Patent Document 2) was proposed as a method to solve the problem. However, this document fails to disclose a specific example of HFE.

However, even in the above method, HFE has a low solubility for the hydrocarbon solvent used for cleaning, depending on its kind, and the hydrocarbon solvent cannot be sufficiently removed by rinsing the article to be cleaned, with HFE, so that the hydrocarbon solvent remains on a surface of the article to be cleaned; this caused a problem of defective rinsing such as occurrence of stain.

Patent Document 1: JP-A-H05-271692 (claims)

Patent Document 2: JP-A-H10-202209 (claims)

DISCLOSURE OF THE INVENTION

Problem To Be Solved By The Invention

It is an object of the present invention to provide a method for cleaning and rinsing an article, using HFE, which was heretofore difficult to apply to rinsing because of its insufficient solubility for a hydrocarbon solvent, and method with excellent cleaning performance and rinsing performance.

Means For Solving The Problem

The present invention provides a method for cleaning and rinsing an article, comprising a cleaning step of contacting an article having a contaminant attached, with a hydrocarbon solvent containing an aromatic hydrocarbon or a glycol ether, and a rinsing step of contacting it with a fluorinated ether, wherein the fluorinated ether is a compound represented by the formula 1:

$$R^1—O—R^2 \qquad \text{formula 1}$$

wherein each of $R^1$ and $R^2$ which are independent of each other, is a fluorinated alkyl group, wherein the number of fluorine atoms contained in each of $R^1$ and $R^2$ is at least one, and the total number of carbon atoms contained in $R_1$ and $R^2$ is from 4 to 8.

The present invention uses the hydrocarbon solvent containing an aromatic hydrocarbon or a glycol ether in the cleaning step, whereby excellent rinsing performance can be demonstrated in the rinsing step with HFE.

Effect of the Invention

The present invention enables the compound represented by the formula 1, which was heretofore difficult to apply to rinsing, to be used in the rinsing step, thereby achieving excellent cleaning performance and rinsing performance.

BEST MODE FOR CARRYING OUT THE INVENTION

The fluorinated ether in the present invention is a compound represented by the formula 1. Each of $R^1$ and $R^2$ has at least one fluorine atom, preferably from 2 to 10 fluorine atoms, and the total number of carbon atoms contained in $R_1$ and $R^2$ is from 4 to 8. The fluorinated ether in the present invention is superior in thermal stability to HFE either $R_1$ or $R^2$ of which contains a fluorine atom.

Specific examples of the fluorinated ether represented by the formula 1 include 1,1,2,2-tetrafluoroethyl-2,2,2-trifluoroethyl ether ($CHF_2CF_2$—O—$CH_2CF_3$, hereinafter referred to as "HFE347"), 1,1,2,2-tetrafluoroethyl-2,2,3,3-tetrafluoropropyl ether ($CHF_2CF_2$—O—$CH_2CF_2CHF_2$, hereinafter referred to as "HFE458") and so on. In the present invention, the fluorinated ether may be used singly, or at least two types of fluorinated ethers may be used as mixed.

Furthermore, since drying is effected by replacing the hydrocarbon solvent on the surface of the article coated therewith, with the fluorinated ether, the fluorinated ether is preferably one having a boiling point of from 30 to 100° C., and more preferably one having the total number of carbon atoms contained in $R^1$ and $R^2$, in a range of from 4 to 6.

The hydrocarbon solvent to be used in the cleaning step of the present invention contains an aromatic hydrocarbon or a glycol ether.

The aromatic hydrocarbon is preferably one having the number of carbon atoms in a range of from 7 to 10 in particular in view of high detergency, a high flash point and high solubility for the fluorinated ether represented by the formula 1, and further preferably one having 9 or 10 carbon atoms. Specific examples of the aromatic hydrocarbon include toluene, xylene, mesitylene, methyl ethyl benzene, diethyl benzene, and so on. Among others, methyl ethyl benzene is preferably applicable because of its adequate solubility for the compound represented by the formula 1.

Specific preferred examples of the glycol ether include alkyl ethers of diethylene glycol and alkyl ethers of dipropylene glycol from the viewpoint of high solubility for the fluorinated ether represented by the formula 1. More Specific examples include the compounds listed below.

Diethylene glycol type ethers such as diethylene glycol monomethyl ether, diethylene glycol monoethyl ether, diethylene glycol mono normal propyl ether, diethylene glycol mono isopropyl ether, diethylene glycol mono normal butyl ether, diethylene glycol mono isobutyl ether, diethylene glycol dimethyl ether, diethylene glycol diethyl ether, diethylene glycol dibutyl ether, and so on.

Dipropylene glycol type ethers such as dipropylene glycol monomethyl ether, dipropylene glycol monoethyl ether, dipropylene glycol mono normal propyl ether, dipropylene glycol mono isopropyl ether, dipropylene glycol mono normal butyl ether, dipropylene glycol mono isobutyl ether, and so on.

The total of the content of the aromatic hydrocarbon and the content of the glycol ether in the hydrocarbon solvent is preferably at least 10 mass %, and more preferably at least 30 mass % from the viewpoint of enhancing the solubility between the fluorinated ether represented by the formula 1 and the hydrocarbon solvent and carrying out rinsing efficiently in a short period of time.

The hydrocarbon solvent of the present invention may further contain an aliphatic hydrocarbon in addition to the aromatic hydrocarbon or glycol ether. The aliphatic hydrocarbon has the advantage that it has thermal stability higher than that of other hydrocarbon solvents, in addition to its low price and high cleaning performance.

The aliphatic hydrocarbon is preferably a linear or branched saturated hydrocarbon having at least 8 carbon atoms, and specific examples thereof include n-octane, n-decane, n-undecane, n-dodecane, kerosene, mineral spirits, and so on.

Cleaning of an article is normally carried out under warming at from 30 to 100° C., and the hydrocarbon solvent preferably has a boiling point of at least 100° C., particularly preferably at least 150° C., because the boiling point of the hydrocarbon solvent is preferably higher than the cleaning temperature.

It is preferred to select a combination of the fluorinated ether and the hydrocarbon solvent so that the difference between the boiling points of the hydrocarbon solvent and the fluorinated ether is at least 50° C., from the viewpoint of efficiently separating and recovering the hydrocarbon solvent and the fluorinated ether by distillation in a process of collecting them from the cleaning step and the rinsing step.

Specific examples of the preferred combination of the fluorinated ether used in the rinsing step and the hydrocarbon solvent used in the cleaning step are as follows: in a case where the fluorinated ether is HFE347 or HFE458, the hydrocarbon solvent may be one selected from an aromatic hydrocarbon having 9 carbon atoms such as methyl ethyl benzene, a mixture of an aromatic hydrocarbon having 9 carbon atoms and diethylene glycol mono-n-butyl ether, a mixture of n-decane and diethylene glycol mono-n-butyl ether, a mixture of n-dodecane, n-undecane and diethylene glycol mono-n-butyl ether, and so on.

Furthermore, the hydrocarbon solvent in the present invention may contain at least one member selected from alcohols, nitrogen-containing organic compounds and organosilicon compounds, if necessary, and specific examples thereof include the compounds listed below.

Alcohols: 2-ethylbutyl alcohol, 2-ethylhexyl alcohol, nonyl alcohol, decyl alcohol and cyclohexanol.

Nitrogen-containing organic compounds: N-methyl-2-pyrrolidone and 1,3-dimethyl-2-imidazolidinone. Organosilicon compounds: dimethyl polysiloxane, cyclopolysiloxane and octamethyl cyclotetrasiloxane.

In the present invention, the rinsing step may also be carried out using the fluorinated ether containing a rinsing auxiliary. The rinsing auxiliary to be used can be one selected from hydrocarbons, lower alcohols and ketones. A mixing rate of the rinsing auxiliary is preferably less than 20 mass % based on the total amount of the fluorinated ether and the rinsing auxiliary, more preferably less than 10 mass % to prevent the mixture to become flammable.

Since the fluorinated ether is subjected to distillation for reuse, the rinsing auxiliary is preferably one having a boiling point of from 30 to 100° C. as in the case of the fluorinated ether, in order to increase recovery efficiency of the rinsing auxiliary. Furthermore, a more preferred case is such that a solution mixture of the fluorinated ether and the rinsing auxiliary is an azeotropic or azeotropic-like composition, because it becomes unnecessary to adjust an amount of the rinsing auxiliary to be added, after distillation and because vapor cleaning can be further carried out with the mixture of the fluorinated ether and the rinsing auxiliary after the rinsing step.

Specific examples of the rinsing auxiliary include the compounds listed below.

Hydrocarbons: n-pentane, n-hexane, isohexane, n-heptane, isooctane, cyclopentane, cyclohexane and methylcyclohexane.

Lower alcohols: methyl alcohol, ethyl alcohol, n-propyl alcohol, isopropyl alcohol and butyl alcohol.

Ketones: acetone and methyl ethyl ketone.

The method for cleaning and rinsing an article having a contaminant attached according to the present invention will be described below in accordance with a specific procedure.

First, the hydrocarbon solvent is brought into contact with an article having a contaminant attached. The method for contacting the article with the hydrocarbon solvent can be implemented by any one of appropriate methods such as a method of immersing the article into the hydrocarbon solvent, and a method of spraying the hydrocarbon solvent onto the article.

A temperature at the time of contact of the article with the hydrocarbon solvent is preferably selected in a range not including the flash point of the hydrocarbon solvent, and slight warming is preferred, in order to enhance removal of the contaminant. Specifically, it is preferred to immerse the article in a bath of the hydrocarbon solvent at a temperature lower by at least 10° C. than the flash point. In addition, in the contact method by immersion, a means for applying a mechanical force such as ultrasonic vibration, stirring, swing and brushing may be used in combination in order to enhance dissolution and removal of the contaminant. A contact time of the article with the hydrocarbon solvent is so set that the contaminant is removed to a desired degree.

Then the article, which was cleaned by contact with the hydrocarbon solvent, is rinsed by contact with a rinsing liquid composed of the fluorinated ether. The method for contacting the article with the rinsing liquid can also be implemented by a method of immersing the cleaned article in the rinsing liquid, a method of spraying the rinsing liquid onto the cleaned article, a method of contacting the cleaned article with vapor of the rinsing liquid, or the like.

Furthermore, in order to raise the rinsing efficiency, the same rinsing method may be repeated or different rinsing methods may be carried out in combination. Particularly, the rinsing efficiency is increased by a combination of the immersing method or the spraying method with the method of contact with vapor. In this case, it is preferred to immerse the cleaned article in the rinsing liquid or to spray the rinsing liquid onto the cleaned article, and then to expose the article to the vapor to effect rising.

Furthermore, in the case where the cleaned article is immersed in the rinsing liquid and then brought into contact with the vapor to effect rinsing, it is preferred to set the rinsing liquid immediately before the contact with the vapor at a temperature lower by at least 10° C. than the boiling point of the fluorinated ether because the rinsing efficiency can be enhanced. This is because the fluorinated ether continues to condense on the surface of the cleaned article until the cleaned article is heated to the boiling point of the fluorinated ether.

EXAMPLES

Now, examples and comparative examples of the present invention will be described below. Examples 1, 2, 4 to 8, 10 to 14, 16 to 20, and 22 to 24 are examples of the present invention and Examples 3, 9, 15 and 21 are comparative examples.

Examples 1 to 6

Mixed solutions of HFE347 (boiling point 56° C.) or an azeotropic composition of HFE347 and ethanol (HFE347/ethanol=94.5/5.5 (based on mass), boiling point 54° C.), with one of hydrocarbon solvents as listed in Table 1 were prepared and measurement for each mixed solution was conducted to determine a maximum content of each hydrocarbon solvent in which the mixed solution did not undergo phase separation into two phases. The maximum content of each of the above hydrocarbon solvents was measured by adding the hydrocarbon solvent to 100 g of HFE at 25° C. until the phase separation occurred.

Table 1 shows the measurement results. In the "measurement results" in Table 1, ◎ indicates that the maximum content of the hydrocarbon solvent was at least 50%; ○ the maximum content of the hydrocarbon solvent was from 30 to 50%; and X the maximum content of the hydrocarbon solvent was less than 30%.

TABLE 1

| HFE | Example | Hydrocarbon solvent (boiling point) | Flash point [° C.] | Measurement result |
|---|---|---|---|---|
| HFE347 | 1 | methyl ethyl benzene (160° C.) | 44 | ◎ |
| | 2 | diethylene glycol mono-n-butyl ether (230° C.) | 230 | ◎ |
| | 3 | n-decane (174° C.) | 46 | X |
| | 4 | n-decane (174° C.)/diethylene glycol mono-n-butyl ether (230° C.) = 80/20 | 46< | ◎ |
| | 5 | n-decane (174° C.)/diethylene glycol mono-n-butyl ether (230° C.) = 90/10 | 46< | ○ |
| HFE347/ethanol = 94.5/5.5 | 6 | n-decane (174° C.)/diethylene glycol mono-n-butyl ether (230° C.) = 90/10 | 46< | ◎ |

Examples 7 to 12

Mixed solutions of HFE458 (boiling point 93° C.) or an azeotropic composition of HFE458 and ethanol (HFE458/ethanol=71.0/29.0 (based on mass), boiling point 74° C.), with on of hydrocarbon solvents as listed in Table 2 were prepared and measurement for each mixed solution was conducted to determine a maximum content of each hydrocarbon solvent in which the mixed solution did not undergo phase separation into two phases, in the same manner as in Examples 1 to 6. Table 2 shows the measurement results. Symbols ◎, ○ and X in the "measurement results" in Table 2 represent the same meanings as in Table 1.

TABLE 2

| HFE | Example | Hydrocarbon solvent (boiling point) | Flash point [° C.] | Measurement result |
|---|---|---|---|---|
| HFE458 | 7 | methyl ethyl benzene (160° C.) | 44 | ◎ |
| | 8 | diethylene glycol mono-n-butyl ether (230° C.) | 230 | ◎ |
| | 9 | n-decane (174° C.) | 46 | X |
| | 10 | n-decane (174° C.)/diethylene glycol mono-n-butyl ether (230° C.) = 85/15 | 46< | ◎ |
| | 11 | n-decane (174° C.)/diethylene glycol mono-n-butyl ether (230° C.) = 95/5 | 46< | X |
| HFE458/ethanol = 71.0/29.0 | 12 | n-decane (174° C.)/diethylene glycol mono-n-butyl ether (230° C.) = 95/5 | 46< | ◎ |

Examples 13 to 18

A 100-mesh wire netting cut into a size of 50 mm×50 mm was immersed in each of the hydrocarbon solvents as listed in Table 1, for one minute and then immersed in HFE347 or an azeotropic composition of HFE347 and ethanol at room temperature for 3 minutes. Thereafter, the wire netting was pulled out, and then the appearance of each wire netting was observed. Table 3 shows the evaluation results. In Table 3, ◎ indicates no stain observed; ○ slight stain observed; and X obvious stain observed.

TABLE 3

| HFE | Example | Hydrocarbon solvent | Flash point [° C.] | Bath temperature [° C.] | Evaluation result |
|---|---|---|---|---|---|
| HFE347 | 13 | methyl ethyl benzene | 44 | 30 | ◎ |
| | 14 | diethylene glycol mono-n-butyl ether | 230 | 30 | ◎ |
| | 15 | n-decane | 46 | 30 | X |
| | 16 | n-decane/diethylene glycol mono-n-butyl ether = 80/20 | 46< | 30 | ◎ |
| | 17 | n-decane/ | 46< | 30 | ○ |

TABLE 3-continued

| HFE | Example | Hydrocarbon solvent | Flash point [° C.] | Bath temperature [° C.] | Evaluation result |
|---|---|---|---|---|---|
| | | diethylene glycol mono-n-butyl ether = 90/10 | | | |
| HFE347/ethanol = 94.5/5.5 | 18 | n-decane/diethylene glycol mono-n-butyl ether = 90/10 | 46< | 30 | ◎ |

Examples 19 to 24

A 100-mesh wire netting cut into a size of 50 mm×50 mm was immersed in each of the hydrocarbon solvents as listed in Table 2, for one minute and then immersed in HFE458 or an azeotropic composition of HFE458 and ethanol at room temperature for 3 minutes. Thereafter, the wire netting was pulled out, and then the appearance of each wire netting was observed. Table 3 shows the evaluation results. In Table 3, ◎ indicates no stain observed; ○ slight stain observed; and X obvious stain observed.

TABLE 4

| HFE | Example | Hydrocarbon solvent | Flash point [° C.] | Bath temperature [° C.] | Evaluation result |
|---|---|---|---|---|---|
| HFE458 | 19 | methyl ethyl benzene | 44 | 30 | ◎ |
| | 20 | diethylene glycol mono-n-butyl ether | 230 | 30 | ◎ |
| | 21 | n-decane | 46 | 30 | X |
| | 22 | n-decane/diethylene glycol mono-n-butyl ether = 85/15 | 46< | 30 | ◎ |
| | 23 | n-decane/diethylene glycol mono-n-butyl ether = 95/5 | 46< | 30 | ○ |
| HFE458/ethanol = 71.0/29.0 | 24 | n-decane/diethylene glycol mono-n-butyl ether = 95/5 | 46< | 30 | ◎ |

The entire disclosure of Japanese Patent Application No. 2003-184722 filed on Jun. 27, 2003 including specification, claims and summary is incorporated herein by reference in its entirety.

What is claimed is:

1. A method for cleaning and rinsing an article, comprising:

(i) cleaning an article having a contaminant attached comprising contacting the article with a hydrocarbon solvent comprising an aromatic hydrocarbon and a glycol ether, and (ii) rinsing the article contacted with the hydrocarbon solvent in (i) with a fluorinated ether, wherein the fluorinated ether is a compound represented by the formula 1:

R1—O—R2 Formula 1, wherein each of R1 and R2 which are independent of each other, is a fluorinated alkyl group, wherein the number of fluorine atoms contained in each of R1 and R2 is at least one, and the total number of carbon atoms contained in R1 and R2 is from 4 to 8.

2. The cleaning and rinsing method according to claim 1, wherein the fluorinated ether is 1,1,2,2-tetrafluoroethyl-2,2,2-trifluoroethyl ether, 1,1,2,2-tetrafluoroethyl-2,2,3,3-tetrafluoropropyl ether or a mixture thereof.

3. The cleaning and rinsing method according to claim 1, wherein the hydrocarbon solvent comprises methyl ethyl benzene as the aromatic hydrocarbon.

4. The cleaning and rinsing method according to claim 1, wherein the total content of the aromatic hydrocarbon and the glycol ether in the hydrocarbon solvent is at least 10 mass %.

5. The cleaning and rinsing method according to claim 1, wherein the hydrocarbon solvent further comprises an aliphatic hydrocarbon.

6. The cleaning and rinsing method according to claim 5, wherein the aliphatic hydrocarbon is a linear or branched saturated hydrocarbon having at least 8 carbon atoms.

7. The cleaning and rinsing method according to claim 1, wherein the hydrocarbon solvent has a boiling point of at least 100° C.

8. The cleaning and rinsing method according to claim 1, wherein the hydrocarbon solvent has a boiling point of at least 150° C.

9. The cleaning and rinsing method according to claim 1, wherein the cleaning of the article is carried out under warming from 30 to 100° C.

10. The cleaning and rinsing method according to claim 1, wherein the hydrocarbon solvent further comprises at least one member selected from the group consisting of alcohols, nitrogen-containing organic compounds and organosilicon compounds.

11. The cleaning and rinsing method according to claim 1, wherein the fluorinated ether comprises a rinsing auxiliary.

12. The cleaning and rinsing method according to claim 11, wherein the rinsing auxiliary has a boiling point from 30 to 100° C.

13. The cleaning and rinsing method according to claim 11, wherein the rinsing auxiliary is at least one selected form the group consisting of hydrocarbons, lower alcohols, and ketones.

14. The cleaning and rinsing method according to claim 1, wherein a difference between boiling points of the hydrocarbon solvent and the fluorinated ether is at least 50° C.

15. The cleaning and rinsing method according to claim 1, wherein the hydrocarbon solvent does not comprise a fluorinated solvent.

16. The cleaning and rinsing method according to claim 1, wherein the total content of the aromatic hydrocarbon and the glycol ether in the hydrocarbon solvent is at least 30 mass %.

* * * * *